US012352130B1

(12) United States Patent
Al-Mousa et al.

(10) Patent No.: US 12,352,130 B1
(45) Date of Patent: Jul. 8, 2025

(54) OFF-BOTTOM TUBULAR SHOE-TRACK WITH SHEARABLE MECHANISMS

(71) Applicant: SAUDI ARABIAN OIL COMPANY, Dhahran (SA)

(72) Inventors: Ahmed Abdulaziz Al-Mousa, Dhahran (SA); Linlin Wang, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/669,272

(22) Filed: May 20, 2024

(51) Int. Cl.
*E21B 33/14* (2006.01)
*E21B 17/14* (2006.01)
*E21B 33/127* (2006.01)

(52) U.S. Cl.
CPC ..... *E21B 33/14* (2013.01); *E21B 17/14* (2013.01); *E21B 33/127* (2013.01)

(58) Field of Classification Search
CPC ..... E21B 34/142; E21B 34/12; E21B 33/14; E21B 33/165
See application file for complete search history.

(56) References Cited

U.S. PATENT DOCUMENTS 2,121,051 A * 6/1938 Ragan ..... E21B 33/1293 166/122
3,270,814 A * 9/1966 Richardson ..... E21B 33/127 166/387
4,133,386 A * 1/1979 Knox ..... E21B 33/14 166/212
4,155,404 A * 5/1979 Hollingsworth ..... E21B 33/127 166/187
4,655,286 A * 4/1987 Wood ..... E21B 33/127 166/185
5,437,330 A 8/1995 Gambertoglio
6,679,336 B2 1/2004 Musselwhite et al.
6,729,393 B2 * 5/2004 Vincent ..... E21B 34/06 166/317
6,755,256 B2 * 6/2004 Murley ..... E21B 43/10 166/313
7,610,963 B2 * 11/2009 Unsgaard ..... E21B 33/16 166/291
8,657,004 B2 * 2/2014 Zhou ..... E21B 34/14 166/290
10,246,968 B2 * 4/2019 Budde ..... E21B 33/165
(Continued)

OTHER PUBLICATIONS

Fuller, M.S. et al., "IADC/SPE 39349: Innovative Way To Cement a Liner Utilizing a New Inner String Liner Cementing Process," SPE International, Society of Petroleum Engineers, pp. 501-504, Mar. 3-6, 1998 (4 pages).

*Primary Examiner* — Kenneth L Thompson
(74) *Attorney, Agent, or Firm* — Osha Bergman Watanabe & Burton LLP

(57) ABSTRACT

A system includes a tubular deployed in a wellbore and configured to be cemented in the wellbore, a removable shoe track removably connected to a distal end of the tubular through a shear pin and configured to deploy cement to an annulus of the tubular, and an inflatable bag disposed on the tubular and configured to inflate to seal the annulus of the tubular when the removable shoe track is sheared, using the shear pin, from the tubular after the tubular is cemented in the wellbore but before the cement has set. The removable shoe track is configured to drop to a bottom of the wellbore after the removable shoe track has sheared from the tubular.

20 Claims, 6 Drawing Sheets

(56) References Cited

U.S. PATENT DOCUMENTS

| | | | | |
|---|---|---|---|---|
| 10,316,626 | B2 * | 6/2019 | Keshishian | E21B 43/10 |
| 12,228,009 | B2 * | 2/2025 | Haugland | E21B 37/02 |
| 2008/0251253 | A1 | 10/2008 | Lumbye | |
| 2016/0010400 | A1 | 1/2016 | Goebel | |
| 2017/0130536 | A1 | 5/2017 | Stam et al. | |
| 2023/0175358 | A1 | 6/2023 | Sehsah et al. | |

* cited by examiner

OFF-BOTTOM TUBULAR SHOE-TRACK WITH SHEARABLE MECHANISMS

BACKGROUND

Hydrocarbons are located in porous reservoirs beneath the Earth's surface. Wells are drilled into these reservoirs to access and produce the hydrocarbons. Drilling a well includes drilling a wellbore (i.e., a hole) into the Earth's surface, tripping at least one casing string into the wellbore, and cementing the casing string in place. Certain well designs include a liner that is hung off within a shallower-placed tubular, also cemented in place. The casing string and liner are used to define the structure of the well, provide support for the wellbore walls, prevent fluid migration between reservoirs, and prevent unwanted fluid from being produced. The casing string and liner are cemented in place to prevent formation fluids from exiting the formation and provide further structure for the well.

After a casing string or liner has been placed in the well, the annulus located outside the casing string and liner must be cemented completely (i.e., to surface) or partially. This is done by pumping cement from the surface, through the inside of the casing string/liner, and up the outside of the casing string/liner (the annulus) to the required height. Oftentimes, the slurry of cement is followed by another type of fluid and/or a wiper plug to push the remainder of the cement out of the inside of the casing/liner and into the annulus, leaving an amount of cement inside of the casing string/liner. The cement is left to harden before the next section of the well is drilled or the well is completed.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and systems/apparatuses for completing a well. The system includes a tubular deployed in a wellbore and configured to be cemented in the wellbore, a removable shoe track removably connected to a distal end of the tubular through a shear pin and configured to deploy cement to an annulus of the tubular, and an inflatable bag disposed on the tubular and configured to inflate to seal the annulus of the tubular when the removable shoe track is sheared, using the shear pin, from the tubular after the tubular is cemented in the wellbore but before the cement has set. The removable shoe track is configured to drop to a bottom of the wellbore after the removable shoe track has sheared from the tubular.

The method includes deploying a tubular having a removable shoe track in a wellbore, wherein the removable shoe track is removably connected to the tubular using a shear pin; cementing, using cement, an annulus of the tubular through the removable shoe track; shearing the removable shoe track from the tubular using the shear pin; inflating an inflatable bag disposed on the tubular to seal the annulus after the removable shoe track is sheared from the tubular; and dropping the removable shoe track to a bottom of the wellbore after the tubular is cemented in the wellbore but before the cement has set.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

After a hole section of a wellbore has been drilled, a casing string or a liner is run into a well to a planned target depth. This target depth is usually at the "bottom" of the hole section (i.e., anywhere from 3-10 feet (ft) off of the bottom-most portion of the drilled wellbore). However, there are multiple scenarios that prevent the casing/liner from being run to the target depth. These scenarios include running into an obstacle while running in hole, drilling past the planned target depth, missing the planned target depth due to formation uncertainties, etc.

When a casing string/liner cannot be run to the target depth (i.e., "bottom"), the casing string/liner is considered to be "off-bottom" (i.e., the casing string's/liner's deepest point is greater than 10 ft away from the deepest portion of the hole section of the drilled wellbore). In this scenario, the casing string/liner must still be cemented in place.

Figure 1B:
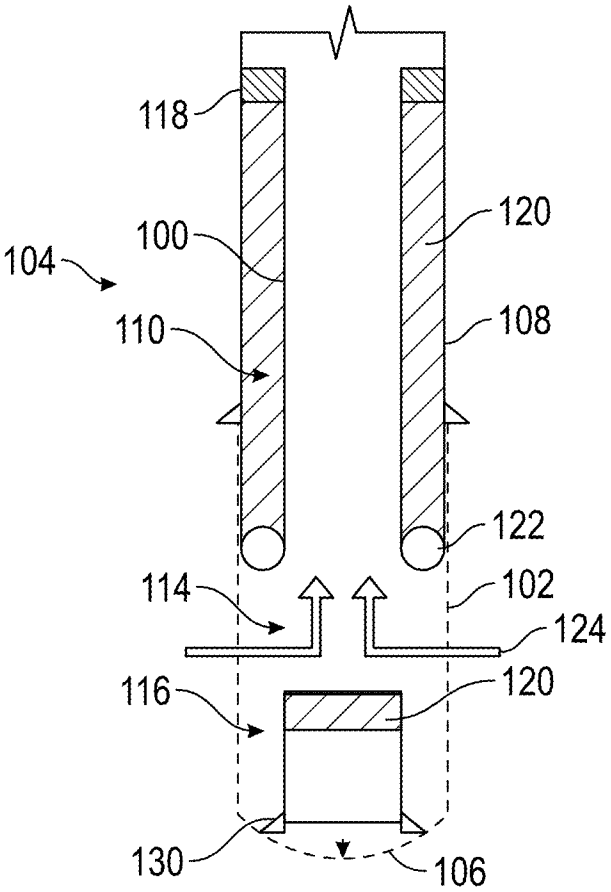
FIGS. 1A-1B show an off-bottom liner deployed in a wellbore of a well in accordance with one or more embodiments.
Figure 1A:
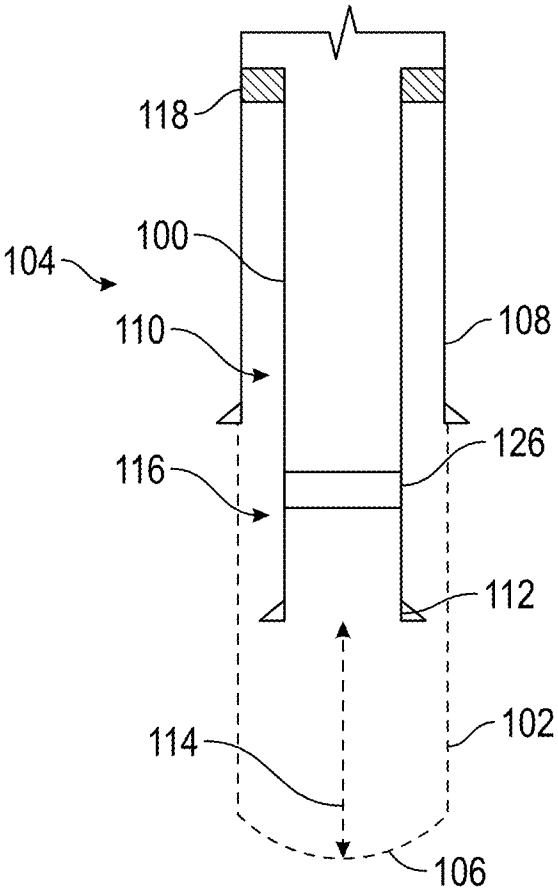

FIGS. 1A-1B show an off-bottom liner (100) deployed in a wellbore (102) of a well (104) in accordance with one or more embodiments. Specifically, FIG. 1A shows the liner (100) run to an off-bottom depth within the wellbore (102). FIG. 1B shows the liner (100) after a cement job has been performed on the liner (100), and a removable shoe track (116) has detached from the liner (100) and fallen to the bottom (106) of the wellbore (102).

The well (104) shown herein is used for example purposes only and a person skilled in the art will appreciate that the well (104) may have any wellbore schematic, well design, well trajectory, completion design, etc. without departing from the scope of the disclosure herein. For example, the embodiments shown herein disclose an off-bottom liner (100), but any tubular that is set off-bottom in a wellbore (102) and must be cemented in place, such as a casing string, may be used.

The wellbore (102) is a hole drilled into the surface of the Earth. The wellbore (102) is typically drilled in a series of hole sections that each extend the depth of the wellbore (102), depending on the design of the well (104). The wellbore (102) has a bottom (106) defined by the deepest-most point (within the Earth) that the wellbore (102) reaches. A person skilled in the art will appreciate that the well (104) may be drilled vertically or may have horizontal/near-horizontal portions.

Because wells are not always drilled vertically, there may be two "depths" for every given point in a wellbore (102): the measured depth (MD) measured along the actual path of the wellbore (102), and the true vertical depth (TVD), the vertical distance between the datum and the point of interest (typically the surface of the Earth or the rig floor). As such the "deepest-most" point in the wellbore (102) may not be the deepest point along the TVD of the wellbore (102), but the "deepest-most" point may be the deepest point along the MD. To that end, terms such as "deeper" or "shallower" may be in reference to the MD rather than the TVD.

Furthermore, locations of components are described herein in relation to each other using terms such as "up-hole" or "downhole." "Up-hole" may refer to a direction, objects, units, or processes that are positioned relatively closer to the surface entry in a wellbore than another. "Downhole" may refer to a direction, objects, units, or processes that are positioned relatively farther from the surface entry in a wellbore than another.

A casing string (108) has been run in hole and cemented in place within a shallower hole section of the wellbore (102). The current hole section (depicted by the dashed lines) of the wellbore (102) has been drilled through the shoe track of the casing string (108) and through the Earth. After this hole section of the wellbore (102) was drilled, a liner (100) was run into the well (104) and set off-bottom, as shown in FIG. 1A.

The casing string (108) and the liner (100) are both tubulars that are meant to be set and cemented within a wellbore (102). The casing string (108) and the liner (100) are typically composed of a series of tubulars threaded together, or otherwise connected, to form a longer tubular. The liner (100) and the casing string (108) are made of a material that can withstand downhole temperatures and pressures, such as steel or other metal alloys. The liner (100) and the casing string (108) may be made out of the same material as one another or the material may be different. Generally, the primary difference between a casing string and a liner is that a casing string extends to the surface of the Earth, and a liner is hung within a shallower-set tubular, such as a casing string or another liner.

The liner (100) is hung within the casing string (108), proximate a downhole end of the casing string (108), using a liner hanger (118). The liner (100) has an annulus (110) located between the outer surface of the liner (100) and the inner surface of the wellbore (102). The annulus (110) is also located between the outer surface of the liner (100) and the inner surface of the casing string (108).

The liner (100) has a distal end (112). The distal end (112) is the end of the liner (100) furthest from the surface of the Earth, i.e., closest to the bottom (106) of the wellbore (102). The space between the distal end (112) of the liner (100) and the bottom (106) of the wellbore (102) is called the open hole (114). The open hole (114) is more than 10 feet long when the liner (100) has been set off bottom (106), as in FIG. 1A.

A primary limitation of conventional off-bottom liner (100) systems is having to run a drill string to the top of a conventional liner (100) shoe track after a cementing operation is completed to drill out the conventional shoe track to access the reservoir (also known as clean out operations). This is a limitation because, in high-inclination wellbore (102) sections, it is difficult to properly clean out the well (104).

Moreover, the bottom hole assembly of the clean out assembly may buckle when the weight is increased during the clean out operation. Furthermore, the limited inner diameter of the liner (100) restricts the drilling parameters, causing the clean out operation to last longer and causing the clean out assembly to contact the lower side of the liner (100). Contact with the lower side of the liner (100) may cause the conventional shoe track to back off and misalign with upper part of the liner (100), damaging the liner (100). Thus, it is beneficial to be able to have a cementing system that does not require the liner (100) shoe track to be drilled out.

As such, the present disclosure introduces methods and systems that completely remove the liner (100) shoe track from the remainder of the liner using a removable shoe track (116). Specifically, as shown in FIG. 1B, the removable shoe track (116) is sheared from the liner (100) and drops to the bottom (106) of the wellbore (102) after the cementing job is completed, but before the cement (120) has set, and after the liner (100) has been pressured up to a pre-determined value.

As can been seen in FIG. 1B, the cement (120) from the cementing operation is only located in the annulus (110) of the liner (100) and within a portion of the removable shoe track (116). There is no cement (120) located within the liner (100) or within the open hole (114). One or more dart fins (152) (shown in FIGS. 2A-2C) are used to prevent the cement (120) from falling down the annulus (110) into the open hole (114) during the cement job, before the removable shoe track (116) has detached form the liner (100). An inflatable bag (122) is used to seal the annulus (110) and prevent the cement (120) from falling into the open hole (114) once the removable shoe track (116) has detached from the liner (100).

With the removable shoe track (116) removed from the liner (100), production fluids (124) from the neighboring reservoir are free to flow into the wellbore (102) and flow to the surface via the liner (100) or a production string that may subsequently be set within the liner (100). The removable shoe track (116) is especially beneficial in off-bottom liner (100) systems because the open hole (114) provides the space needed to drop and store the removable shoe track (116). In accordance with one or more embodiments, the removable shoe track (116) includes a circulation sub (126).

Figure 2A:
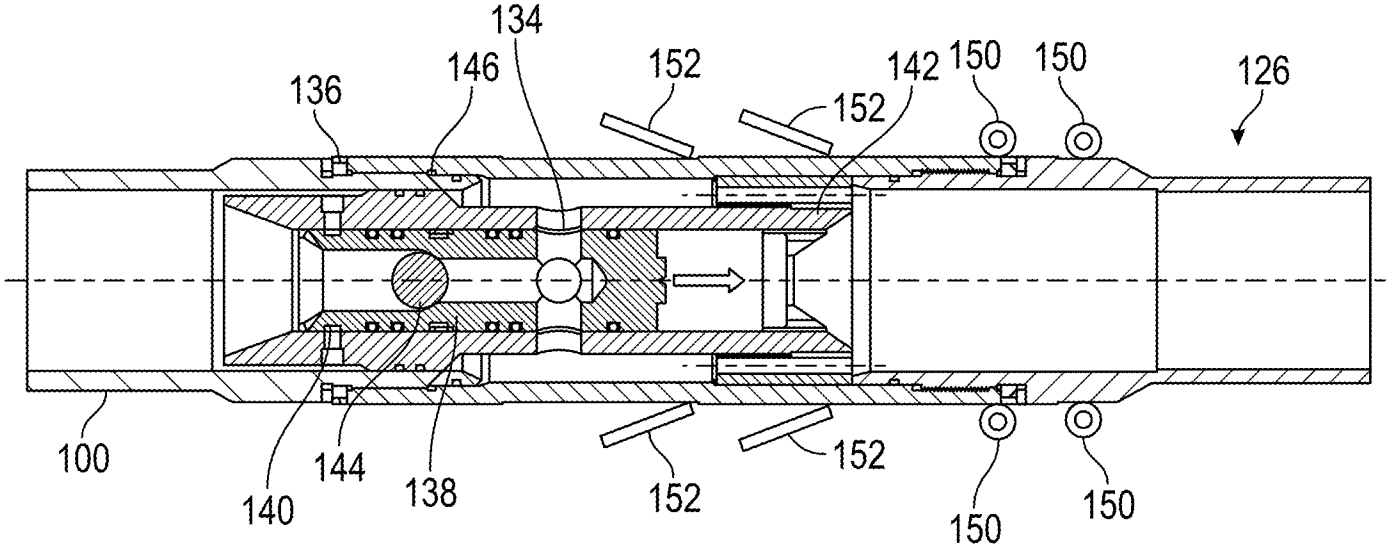
FIGS. 2A-2C show the circulation sub in accordance with one or more embodiments.
Figure 2B:
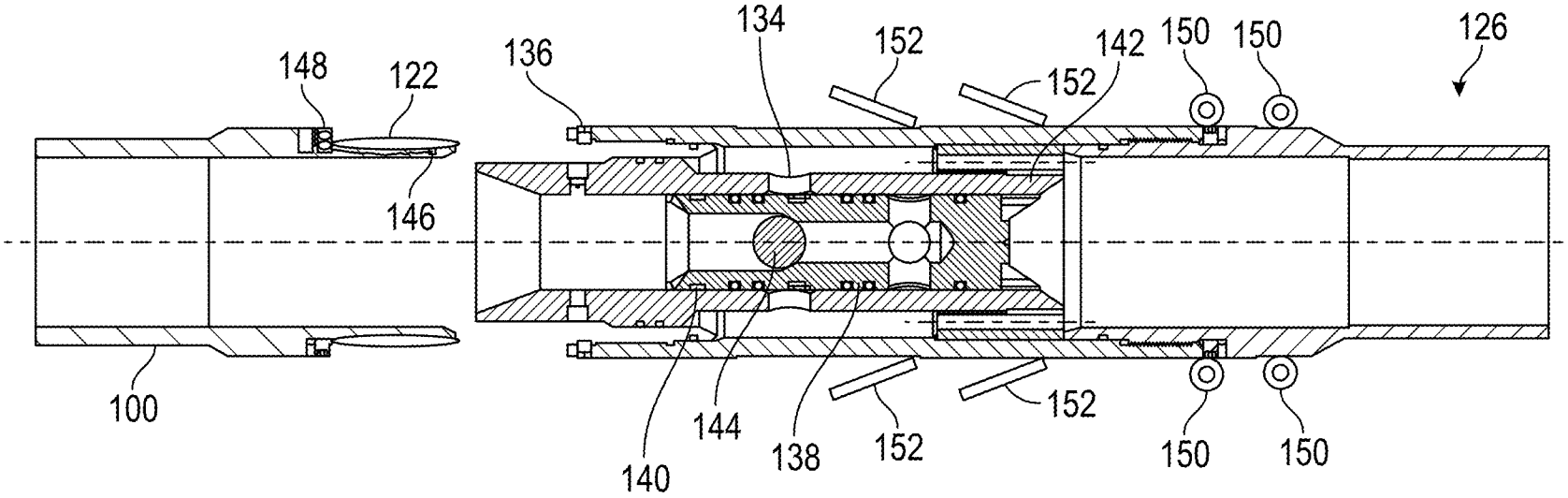
Figure 2C:
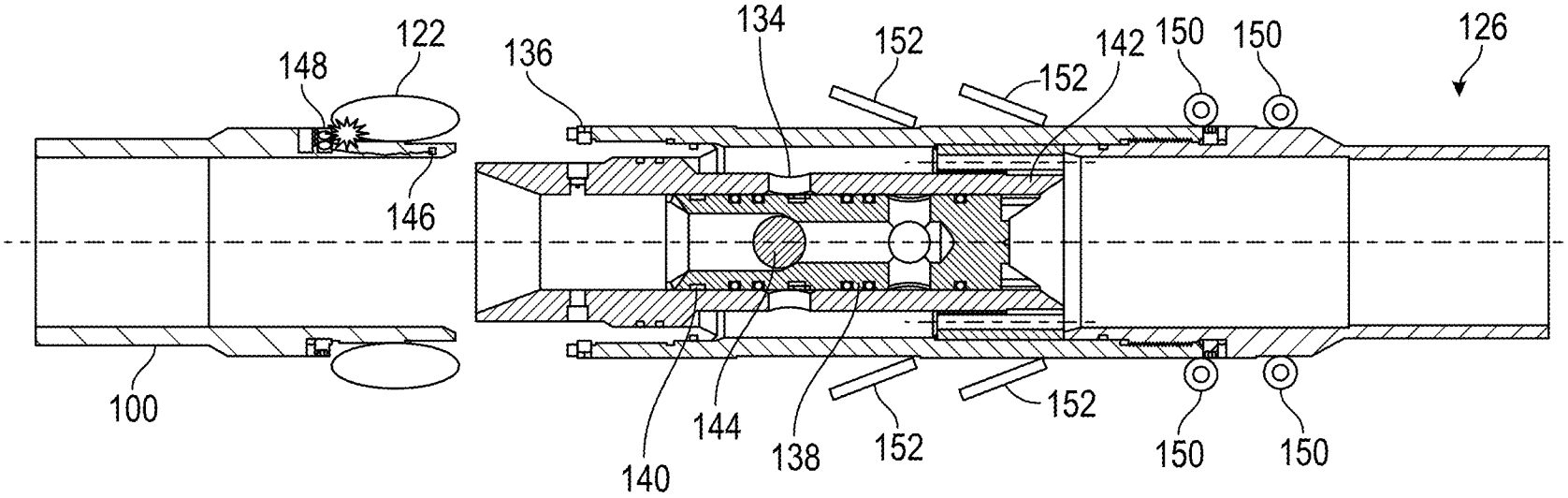

FIGS. 2A-2C show the circulation sub (126) in accordance with one or more embodiments. Specifically, FIG. 2A shows the circulation sub (126) with the circulation ports (134) in an open position. As such, FIG. 2A shows the position that the circulation sub (126) may be in during the cementing operation. FIG. 2B shows the circulation sub (126) just after the removable shoe track (116) has been sheared from the liner (100). FIG. 2C shows the circulation sub (126) after the removable shoe track (116) has been sheared from the liner (100) and the inflatable bags (122) have inflated. Components shown in FIGS. 2A-2C that are the same as or similar to components shown in FIGS. 1A-1B have not be re-described for purposes of readability and have the same description and function as outlined above.

The circulation sub (126) is removably connected to the liner (100) using shear pins (e.g., outer shear pins (136)). FIG. 2A shows the circulation sub (126) connected to the liner (100) via the outer shear pins (136). FIGS. 2B and 2C show the outer shear pins (136) sheared and the circulation sub (126) detached from the liner (100). This detachment causes the entire removable shoe track (116) to be detached from the liner (100), as shown in FIG. 1B, and the removable shoe track (116) can fall to the bottom (106) of the wellbore (102)

The circulation sub (126) includes a ball seat (138) that is movable between a cementing position and a shearing position. The ball seat (138) can be movable via shear pins (e.g., inner shear pins (140)) connecting the ball seat (138) to the body (142) of the circulation sub (126). FIG. 2A shows the ball seat (138) in the cementing position and FIGS. 2B and 2C show the ball seat (138) in the shearing position.

When the ball seat (138) is in the cementing position, as shown in FIG. 2A, the inner shear pins (140) connect the ball seat (138) to the body (142) of the circulation sub (126). After cement (120) has been pumped from the surface, through the interior of the liner (100), out the circulation ports (134), and into the annulus (110)) of the liner (100), a ball (144) may be dropped into the liner (100) to land on the ball seat (138). The ball (144) may also be a cement dart or a cement plug without departing from the scope of the disclosure herein.

With the ball (144) landed on the ball seat (138), fluid is able to be pumped onto the ball (144) to build pressure within the circulation sub (126). Once the pressure has reached a certain value, the inner shear pins (140) may shear, allowing the ball seat (138) to be movable within the circulation sub (126).

At this point the pressure may push the ball seat (138) in a downhole direction to cover the circulation ports (134). The circulation ports (134) may be covered to prevent u-tubing of cement (120) back into the liner (100) because there are no float valves needed for this configuration. Once the ball seat (138) is located at the bottom of the circulation sub (126), the ball seat (138) has nowhere else to move. Thus, pressure may be built again on top of the ball (144). However, this time, the pressure is transferred to the circulation sub (126) as a whole. Once the pressure reaches a certain value, the outer shear pins (136) may shear, detaching the circulation sub (126) (and the remainder of the removable shoe track (116)) from the liner (100). In accordance with one or more embodiments, the pressure required to shear the inner shear pins (140) is less than the pressure required to shear the outer shear pins (136).

In accordance with one or more embodiments, the circulation sub (126) (or other portions of the removable shoe track (116)) may be manufactured similar to a rubber dart. For example, the external surface may be coated in rubber and one or more dart fins (152) may extend around the external circumference of the circulation sub (126). The dart fins (152) may centralize the removable shoe track (116) within the wellbore (102). Furthermore, the dart fins (152) may prevent the removable shoe track (116) moving in an up-hole direction, based on the angle of the dart fins (152) and the rubber material.

The dart fins (152) are located downhole from the circulation ports (134) such that the dart fins (152) prevent the cement (120) from falling down the annulus (110) into the open hole (114) during the cement job. Specifically, the dart fins (152) may be shaped like an umbrella or a do-nut and may push up against an inner surface of the casing string (108) to prevent cement (120) from flowing in a direction downhole from the dart fins (152).

In accordance with one or more embodiments, the dart fins (152) are made of high temperature-resistant elastic rubber. A high inclination well may need 1-2 dart fins (152) while a lower inclination well may need 3-4 pieces of dart fins (152) to successfully prevent cement (120) migration.

The inflatable bags (122) are used to seal the annulus (110) outside of the liner (100) after the removable shoe track (116) has disconnected and moved away from the liner (100). This prevents the cement (120) from falling down the annulus (110) into the open hole (114) and allows the cement (120) to set. In accordance with one or more embodiments, the inflatable bags (122) are made of a durable material that can insulate from the outside and operate in the high temperature environment of the well (104), such as nylon or silicon-fiberglass.

The inflatable bags (122) are operable using a shear sensor (146) and an inflator (148). The shear sensor (146) is operably connected to the inflator (148). Preferably, the shear sensor (146) is located near the location where the liner (100) and the circulation sub (126) part from one another. The shear sensor (146) detects when the liner (100) and the circulation sub (126) have parted and sends a signal to the inflator (148) to activate the inflatable bags (122).

In accordance with one or more embodiments, the inflator (148) may activate the inflatable bags (122) using a chemical reaction that creates a gas. For example, the inflatable bag (122) may contain sodium azide and the inflator (148) may contain potassium nitrate. Once the shear sensor (146) sends the signal to the inflator (148), the inflator (148) allows the sodium azide and the potassium nitrate to mix and create a nitrogen gas. The nitrogen gas may then expand the inflatable bags (122) to seal the annulus (110), as shown in FIG. 2C. In other embodiments, the inflator (148) may activate the inflatable bags (122) by allowing fluid to fill the inflatable bags (122).

In accordance with one or more embodiments, the circulation sub (126) (or other portions of the removable shoe track (116)) may have one or more rollers (150) connected to the external surface of the circulation sub (126). The rollers (150) may be used to help the removable shoe track (116) roll to the bottom (106) of the wellbore (102), especially when the wellbore (102) is horizontal or near-horizontal.

The rollers (150) may naturally rotate as gravity pulls the removable shoe track (116) down the wellbore (102). In other embodiments, the rollers (150) may rotate as a hydraulic pressure from the surface pushes the removable shoe track (116) down the wellbore (102). In further embodiments, the removable shoe track (116) may be equipped with a power system (154) that is used to rotate the rollers (150) to move the removable shoe track (116), for example, in near-horizontal or horizontal wellbores (102).

Figure 3:
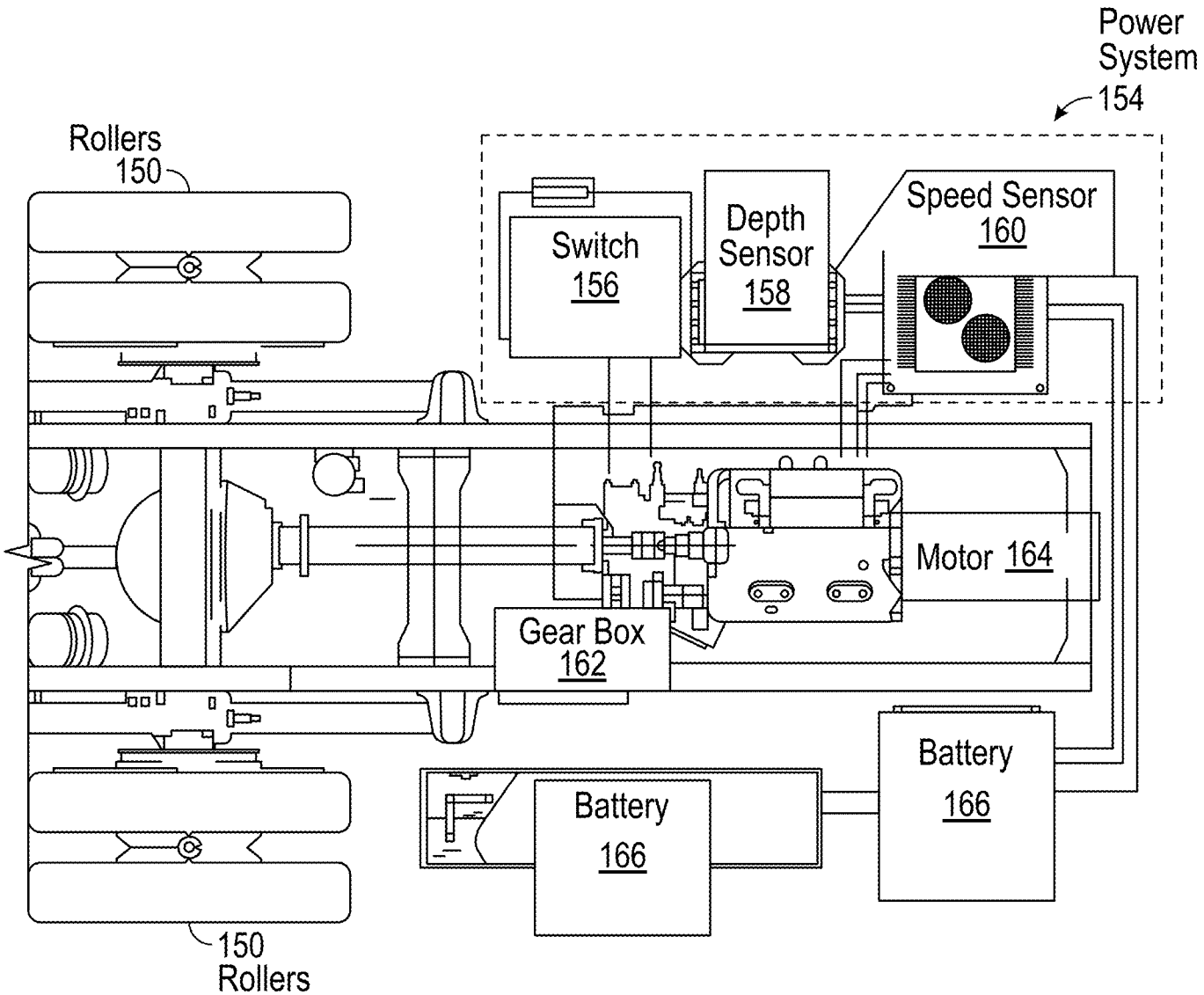
FIG. 3 shows the power system for operating the rollers of the removable shoe track in accordance with one or more embodiments.

FIG. 3 shows the power system (154) for operating the rollers (150) of the removable shoe track (116) in accordance with one or more embodiments. Components shown in FIG. 3 that are the same as or similar to components shown in FIGS. 1A-2C have not be re-described for purposes of readability and have the same description and function as outlined above.

In accordance with one or more embodiments, the power system (154) includes a switch (156), a depth sensor (158), a speed sensor (160), a gear box (162), a motor (164), and at least one battery (166). When the removable shoe track (116) is sheared from the liner (100), the switch (156) will turn on. Once the switch (156) turns on, the motor (164) is powered by the battery (166) and the motor (164) rotates the rollers (150) via the gear box (162).

In accordance with one or more embodiments, the depth sensor (158) will trigger the switch (156) to turn on or off. The depth at which the depth sensor (158) will trigger the switch (156) will be set on surface before the liner (100) is run into the wellbore (102). For example, if the off-bottom liner (100) is designed to be set at 10,000 ft, and the removable shoe track (116) will be sheared off and be pumped down 3 ft, then the depth sensor (158) will be set to 3 ft more than the pre-setup depth (10,003 ft). Thus, when the depth sensor (158) senses it is at 10,003 feet, the depth sensor (158) will trigger the switch (156) to turn on. If the bottom of wellbore is 13,000 ft, then the depth sensor (158) will be set to trigger the switch (156) to turn off when the depth sensor (158) senses the removable shoe track (116) is at 13,000 ft.

In accordance with one or more embodiments, the speed sensor (160) may be used when the wellbore inclination is low, and gravity makes the removable shoe track (116) move downhole too fast. If the removable shoe track (116) moves downhole too fast, it may hit not-smooth portions of the wellbore (102) inner wall and damage the rollers (150). This may be an issue because the removable shoe track (116) may become stuck or may not be able to move further downhole. So, in this case the speed sensor (160) will automatically reduce the speed of the motor (164) whenever the removable shoe track (116) moves faster than a pre-determined speed.

Figure 4:
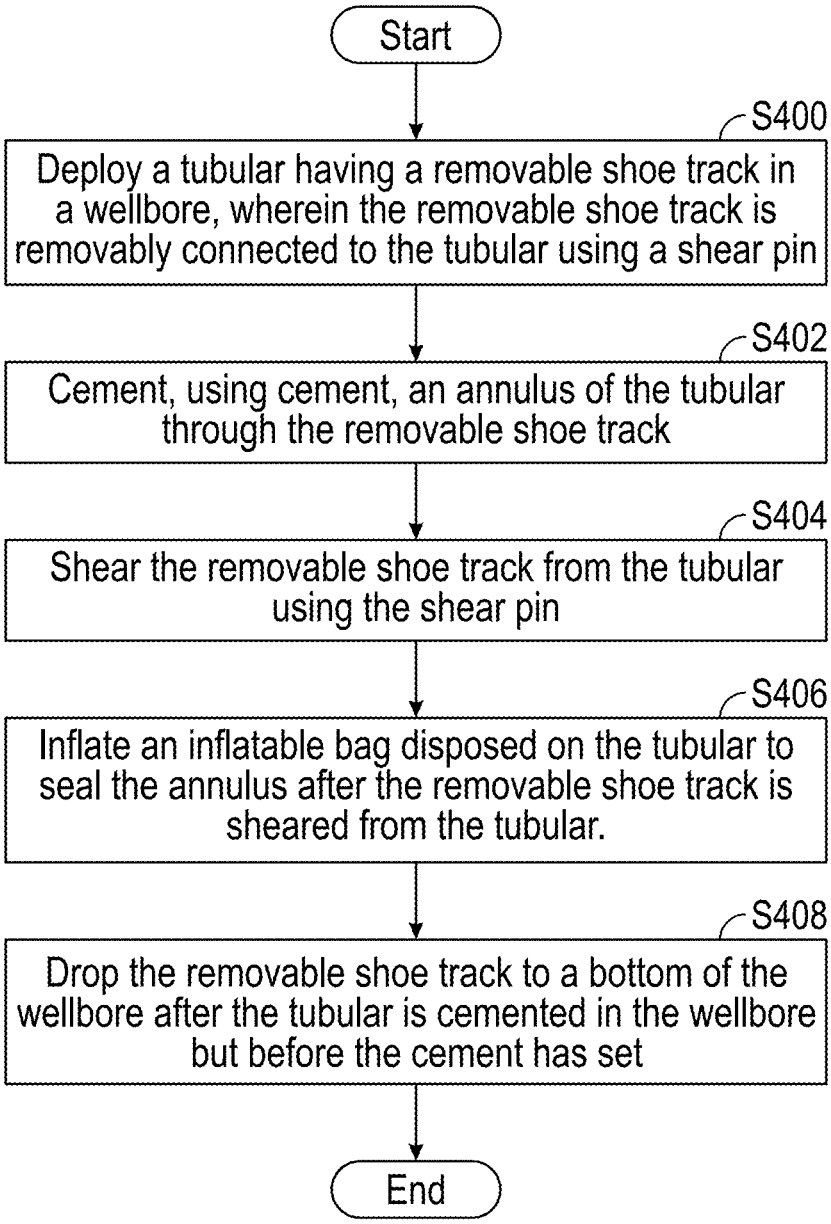
FIG. 4 shows a flowchart in accordance with one or more embodiments.

FIG. 4 shows a flowchart in accordance with one or more embodiments. The flowchart outlines a method for completing a well (104). While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In S400, a tubular having a removable shoe track (116) is deployed in a wellbore (102). The removable shoe track (116) is removably connected to the tubular using a shear pin. In accordance with one or more embodiments, the tubular may be the liner (100) and the shear pin may be the inner shear pins (140) and/or the outer shear pins (136), as outlined above with respect to FIGS. 1A-3.

The removable shoe track (116) may include a circulation sub (126). The circulation sub (126) may be removably connected to the tubular using the outer shear pins (136). The circulation sub (126) may include a ball seat (138). The ball seat (138) may be removably connected to a body (142) of the circulation sub (126) using the inner shear pins (140).

In S402, an annulus (110) of the tubular is cemented, using cement (120), through the removable shoe track (116). In accordance with one or more embodiments, the tubular is cemented using circulation ports (134) in the circulation sub (126). Specifically, the cement (120) is pumped from the surface, through the tubular, into the circulation sub (126), out the circulation ports (134), and into the annulus (110). During this operation, the ball seat (138) is in a cementing position, that is, the ball seat (138) is uncovering the circulation ports (134). The removable shoe track (116) may include one or more dart fins (152) that prevent the cement (120) from falling down the annulus (110) into the open hole (114).

In S404, the removable shoe track (116) is sheared from the tubular using the shear pin. In accordance with one or more embodiments, a ball (144) is dropped into the ball seat (138) from the surface. With the ball (144) in the ball seat (138), pressure can accumulate on top of the ball (144), for example, using hydraulic pressure being pumped from the surface. In accordance with one or more embodiments, the pressure accumulates to a first value to shear the inner shear pins (140) and allow the ball seat (138) to move within the circulation sub (126).

At this point, the pressure applied to the ball (144) pushes the ball seat (138) in a downhole direction to cover the circulation ports (134) (i.e., the ball seat (138) is placed in the shearing position). Once the ball seat (138) covers the circulation ports (134), the pressure can accumulate again on the ball (144). In accordance with one or more embodiments, the pressure accumulates to a second value to shear the outer shear pins (136) which disconnects the removable shoe track (116) from the tubular.

In S406, an inflatable bag (122) disposed on the tubular is inflated to seal the annulus (110) after the removable shoe track (116) is sheared from the tubular. In accordance with one or more embodiments, the inflatable bag (122) is located on an external circumference of the tubular and is inflated using an inflator (148).

Specifically, a shear sensor (146), operably connected to the inflator (148), is used to detect when the removable shoe track (116) has sheared from the tubular. When the shear sensor (146) detects the removal of the removable shoe track (116), a signal is sent to the inflator (148) to automatically inflate the inflatable bag (122).

In accordance with one or more embodiments, the inflator (148) may allow chemicals to mix to create a gas to inflate the inflatable bag (122). In other embodiments, the inflator (148) may pump a fluid into the inflatable bag (122) to expand the inflatable bag (122). The inflatable bag (122) is inflated to a size large enough to block the annulus (110) and prevent the cement (120) from falling down the wellbore (102) while the cement (120) sets.

In S408, the removable shoe track (116) is dropped to a bottom (106) of the wellbore (102) after the tubular is cemented in the wellbore (102) but before the cement (120) has set. In accordance with one or more embodiments, the removable shoe track (116) falls naturally to the bottom (106) of the wellbore (102) using gravity and/or the hydraulic pressure caused by the fluid in the wellbore (102). In other embodiments, rollers (150) are disposed on an external surface of the removable shoe track (116).

The rollers (150) may naturally rotate to help the removable shoe track (116) drop to the bottom (106) of the wellbore (102). In other embodiments, the rollers (150) may be operably connected to a power system (154) that is used to rotate the rollers (150) once the removable shoe track (116) has sheared from the tubular.

In accordance with one or more embodiments, the removable shoe track (116) has a dart fin (152) extending around an external circumference of the removable shoe track (116). The dart fin (152) is angled in such a way that the dart fin (152) impedes movement of the removable shoe track (116) in an up-hole direction and prevents cement (120) from flowing past the dart find (152) into the open hole (114).

At this point, the cement (120) is allowed to set/harden. Once the cement has hardened, the well (104) may be completed with production tubing, with no need to drill out the shoe track or cement (120), because the removable shoe track (116) is located at the bottom (106) of the wellbore (102) beneath the production zone.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system comprising, a tubular deployed in a wellbore and configured to be cemented in the wellbore;

a removable shoe track removably connected to a distal end of the tubular through a shear pin and configured to deploy cement to an annulus of the tubular; and an inflatable bag disposed on the tubular and configured to inflate to seal the annulus of the tubular when the removable shoe track is sheared, using the shear pin, from the tubular after the tubular is cemented in the wellbore but before the cement has set, wherein the removable shoe track is configured to drop to a bottom of the wellbore after the removable shoe track has sheared from the tubular.

2. The system of claim 1, wherein the shear pin comprises an outer shear pin and an inner shear pin.

3. The system of claim 2, wherein the removable shoe track comprises a circulation sub, configured to deploy the cement into the annulus of the tubular using circulation ports, and the circulation sub is removably connected to the tubular using the outer shear pin.

4. The system of claim 3, wherein the circulation sub comprises a ball seat removable connected to a body of the circulation sub using the inner shear pin.

5. The system of claim 4, wherein a ball is configured to be dropped into the ball seat to allow pressure to accumulate within the circulation sub.

6. The system of claim 5, wherein the pressure accumulates to a first value to shear the inner shear pin, allowing the ball seat to move in a downhole direction and cover the circulation ports.

7. The system of claim 6, wherein the pressure accumulates in the circulation sub when the ball seat is covering the circulation ports to a second value to shear the outer shear pin, disconnecting the removable shoe track from the tubular.

8. The system of claim 1, wherein the removable shoe track comprises a dart fin extending around an external circumference of the removable shoe track.

9. The system of claim 1, wherein the removable shoe track further comprises a roller disposed on an external surface of the removable shoe track, wherein the roller is configured to rotate to enable the removable shoe track to fall to the bottom of the wellbore.

10. The system of claim 9, wherein the removable shoe track further comprises a power system operably connected to the roller, wherein the power system is configured to rotate the roller when the removable shoe track is sheared from the tubular.

11. A method comprising:

deploying a tubular having a removable shoe track in a wellbore, wherein the removable shoe track is removably connected to the tubular using a shear pin;

cementing, using cement, an annulus of the tubular through the removable shoe track;

shearing the removable shoe track from the tubular using the shear pin;

inflating an inflatable bag disposed on the tubular to seal the annulus after the removable shoe track is sheared from the tubular; and dropping the removable shoe track to a bottom of the wellbore after the tubular is cemented in the wellbore but before the cement has set.

12. The method of claim 11, wherein the shear pin comprises an outer shear pin and an inner shear pin.

13. The method of claim 12, wherein the annulus of the tubular is cemented through the removable shoe track using circulation ports in a circulation sub of the removable shoe track, and wherein the circulation sub is removably connected to the tubular using the outer shear pin.

14. The method of claim 13, further comprising covering the circulation ports in the circulation sub using a ball seat removably connected to a body of the circulation sub using the inner shear pin.

15. The method of claim 14, wherein covering the circulation ports in the circulation sub using the ball seat further comprises dropping a ball into the ball seat.

16. The method of claim 15, wherein covering the circulation ports in the circulation sub using the ball seat further comprises accumulating pressure on the ball in the ball seat to shear the inner shear pin.

17. The method of claim 15, wherein shearing the removable shoe track from the tubular using the shear pin further comprises accumulating pressure on the ball when the ball seat is covering the circulation ports to shear the outer shear pin.

18. The method of claim 11, further comprising preventing the removable shoe track from moving up-hole using a dart fin extending around an external circumference of the removable shoe track.

19. The method of claim 11, wherein dropping the removable shoe track to the bottom of the wellbore further comprises using rollers disposed on an external surface of the removable shoe track.

20. The method of claim 19, wherein dropping the removable shoe track to the bottom of the wellbore further comprises using a power system to rotate the rollers.

* * * * *